US006624759B2

(12) United States Patent
Tubel et al.

(10) Patent No.: US 6,624,759 B2
(45) Date of Patent: Sep. 23, 2003

(54) REMOTE ACTUATION OF DOWNHOLE TOOLS USING VIBRATION

(75) Inventors: Paulo S. Tubel, The Woodlands, TX (US); Clark Bergeron, The Woodlands, TX (US); Clarence V. Griffin, Kintore (GB)

(73) Assignee: Baker Hughes Incorporated, Houston, TX (US)

( * ) Notice: Subject to any disclaimer, the term of this patent is extended or adjusted under 35 U.S.C. 154(b) by 13 days.

(21) Appl. No.: 10/042,806

(22) Filed: Jan. 9, 2002

(65) Prior Publication Data

US 2002/0057211 A1 May 16, 2002

Related U.S. Application Data

(63) Continuation of application No. 09/239,114, filed on Jan. 28, 1999, now abandoned.

(60) Provisional application No. 60/072,903, filed on Jan. 28, 1998.

(51) Int. Cl.[7] ..... G01V 3/00

(52) U.S. Cl. ..... 340/856.4; 340/854.3; 340/854.4; 340/853.3; 367/82

(58) Field of Search ..... 340/854.3, 854.4, 340/853.3, 856.4; 367/82, 83, 85; 166/166

(56) References Cited

U.S. PATENT DOCUMENTS

| | | | | | |
|---|---|---|---|---|---|
| 4,216,536 | A | * | 8/1980 | More | 367/83 |
| 5,373,481 | A | * | 12/1994 | Orban et al. | 367/82 |
| 5,414,673 | A | * | 5/1995 | Scherbatskoy | 367/25 |
| 5,425,002 | A | * | 6/1995 | Plisek et al. | 367/175 |
| 5,489,354 | A | * | 2/1996 | Gold | 156/108 |
| 5,675,325 | A | * | 10/1997 | Taniguchi et al. | 340/854.4 |
| 5,740,126 | A | * | 4/1998 | Chin et al. | 367/84 |
| 5,787,052 | A | * | 7/1998 | Gardner et al. | 367/84 |
| 5,995,449 | A | * | 11/1999 | Green et al. | 367/83 |
| 6,021,095 | A | * | 2/2000 | Tubel et al. | 367/82 |

FOREIGN PATENT DOCUMENTS

| | | |
|---|---|---|
| EP | 0552833 | 1/1993 |
| GB | 2 288 834 | 11/1995 |
| GB | 2303722 | 2/1997 |
| GB | 2 321 076 | 7/1998 |
| WO | US96/01819 | 2/1996 |
| WO | US96/16670 | 10/1996 |
| WO | WO97/14869 | 4/1997 |

* cited by examiner

*Primary Examiner*—Michael Horabik
*Assistant Examiner*—Albert K. Wong
(74) *Attorney, Agent, or Firm*—Cantor Colburn LLP

(57) ABSTRACT

A communication system is disclosed enabling communication from a surface location to a downhole location where instructions communicated are executed. The system employs accelerometers to sense vibrations traveling within the annulus fluid or the tubing string. The accelerators provide signals representative of the vibration generated at the surface of the well to a microcontroller. The microcontroller is programmed to energize a nichrome element to actuate the downhole tool in response to a user-defined vibration sequence. The vibration sequence includes a defined number of vibration cycles. Each cycle includes alternating periods of vibration and no vibrations with each period lasting for a defined length of time. The user may program the parameters of the sequence and arm the vibration receiving unit on site through a handheld terminal that interfaces with the microcontroller.

47 Claims, 8 Drawing Sheets

```
BOT Pump Detection Ver. 1.00
Current settings:
 pump-on threshold (counts)..05888
 pump-on period (sec.).......005
 pump-off period (sec.)......015
 pump cycle (address)........001

SELECT:
  A. New pump-on threshold (counts)
  B. New pump-on period (sec.)
  C. New pump-off period (sec.)
  D. New pump cycle (address)
  E. ARM tool (PWR Down to DisArm)
  F. Save parameters
  ?. Redisplay
Command:
```

124

FIG. 5

```
Command: a
New value: 5000
Command:
```

126

FIG. 7a

```
Command: e
Confirm (y/n)? y
Armed - Bye!
```

132

FIG. 7b

```
Command: f
Confirm (y/n)? y
Command:
```

134

FIG. 7c

REMOTE ACTUATION OF DOWNHOLE TOOLS USING VIBRATION

CROSS-REFERENCE TO RELATED APPLICATIONS

This application is a continuation application of U.S. Ser. No. 09/239,114 filed Jan. 28, 1999 now abandoned, which claims priority to U.S. provisional patent application Serial No. 60/072,903 filed Jan. 28, 1998.

BACKGROUND OF THE INVENTION

1. Field of the Invention

The invention relates to oil field communication with downhole tools. More particularly, the invention relates to a communication/actuation system wherein vibration is the transmission media. Vibrations provide instructions downhole in a reliable manner for communicating such instructions to downhole tools which then activate. The invention is also directed to more general surface-to-downhole and downhole-to-downhole communications.

2. Prior Art

The prior art teaches one of ordinary skill in the art to provide an apparatus at the surface or other location in a wellbore, to generate an acoustic pressure pulse coupled to the fluid (i.e. liquid) in the tubing string. The pulse is carried downhole to a tool having strain sensors therein capable of sensing the pulse or pulses as they reach the sensor. A programmed sequence of pulses will be awaited by the tool prior to actuation. Upon sensing the programmed sequence, the electronics package in the tool signals an actuation of the tool. This system is set forth in more detail in U.S. Pat. Nos. 5,579,283, 5,343,963 and 5,226,494, all of the contents of which are fully incorporated herein by reference.

While the systems(s) disclosed in the referenced patents are very effective in many situations, they fail to be reliable when there is a gas bubble in the fluid column. As one of ordinary skill in the art will appreciate, the acoustic pulse travels well in its host (liquid) medium but suffers significant losses when crossing an interface with another medium as is the case when there is a "bubble" of gas (e.g. Nitrogen) in the tubing string. When this condition is present, little if any of the message from the surface is effectively communicated downhole because the pulse has been so attenuated by the gas bubble(s) that it lacks sufficient magnitude to be sensed by the strain gauges on the downhole tool. This is, of course, if indeed any portion of the pulse reaches the strain gauges at all. This has been problematic in some wells and therefore needs a remedy. What is needed is a communication means for operating downhole tools that is unmitigated by the type of fluid or hardware through or around which it propagates.

SUMMARY OF THE INVENTION

The above-discussed and other drawbacks and deficiencies of the prior art are overcome or alleviated by the remote actuation/communication system of the invention. The invention provides reliable communication to downhole tools by employing vibration initiators and vibration receivers. The vibrations are created generally at the surface by either an acoustic pulse machine like that disclosed in the prior art listed above or by operating a pump or other machinery. The vibrations are coupled to the well annulus by a hose connected to the vibration generating device and to the well fluid. The hose generally is filled with water but could be filled with another liquid as desired. The liquid in the hose conveys the vibration from the vibration generating machine and transmits the vibration to the well fluid. The vibrations are then propagated downhole naturally in the liquid of the wellbore or in the tubing string. Where an acoustic pulse is employed, it travels down fluid in the annulus of the well in much the same way it travels in the tubing fluid in the prior art. An astute reader will recognize two apparent problems: one is that there may be gas in the annulus which presumptively would create the problem associated with the prior art and two that there may be packers or other hardware located in the annulus that would defeat propagation of the pulse. If strain gauges were used in the invention and waited for a pressure pulse, the concerns set forth would nearly certainly be wrought out but because the invention employs accelerometers to sense vibrations as opposed to pressure pulses, the message is receivable by the downhole tool intended to receive the signal. More specifically, although the pressure pulse would be lost (in a gas bubble) or reflected (e.g. by a packer) the vibration associated with the pulse is coupled to the pipe itself and is propagated through any pulse attenuating areas that would stop or reflect a pressure pulse because the tubing string is continuous. By employing high frequency or high band width accelerometer(s) in vibratory communication with the propagation medium and in electrical communication with a downhole microcontroller-based vibration receiving system, it is possible to reliably provide information to the downhole tool. The microcontroller in a downhole tool will be programmed to await a certain series of signals from the accelerometer and then actuate the tool. By creating pulses with a vibration source, the vibrations associated therewith are sent downhole and sensed by the accelerometer. Similarly, if the vibrations are caused by other machinery they are still received by the accelerometer, which provides a signal to the microcontroller for each vibration event sensed. Alternatively, and more economically, due to the avoidance of the need for the pulse apparatus or other specialized equipment, the rig pump, which, as is appreciated, is already on the rig, may be employed to create the vibrations.

Vibration is inherent in the pipe when fluid is circulated by the rig pump. Therefore, if the pump is turned on and off a number of times and for certain amounts of time to match a programmed vibration sequence in the downhole tool, the accelerometers will pick up the vibration and the tool will actuate. This is a particularly important alternative for smaller drilling companies due to the expense of renting and transporting the pulse apparatus and paying for the technician to run the rented equipment.

BRIEF DESCRIPTION OF THE DRAWINGS

Referring now to the drawings wherein like elements are numbered alike in the several FIGURES:

FIG. 5 is a user main menu provided to a screen display of a handheld terminal for programming the microcontroller of the vibration receiving system;

FIGS. 7*a–c* are user submenus provided to a screen display of a handheld terminal for programming the microcontroller of the vibration receiving system.

DETAILED DESCRIPTION OF THE PREFERRED EMBODIMENTS

Figure 1:
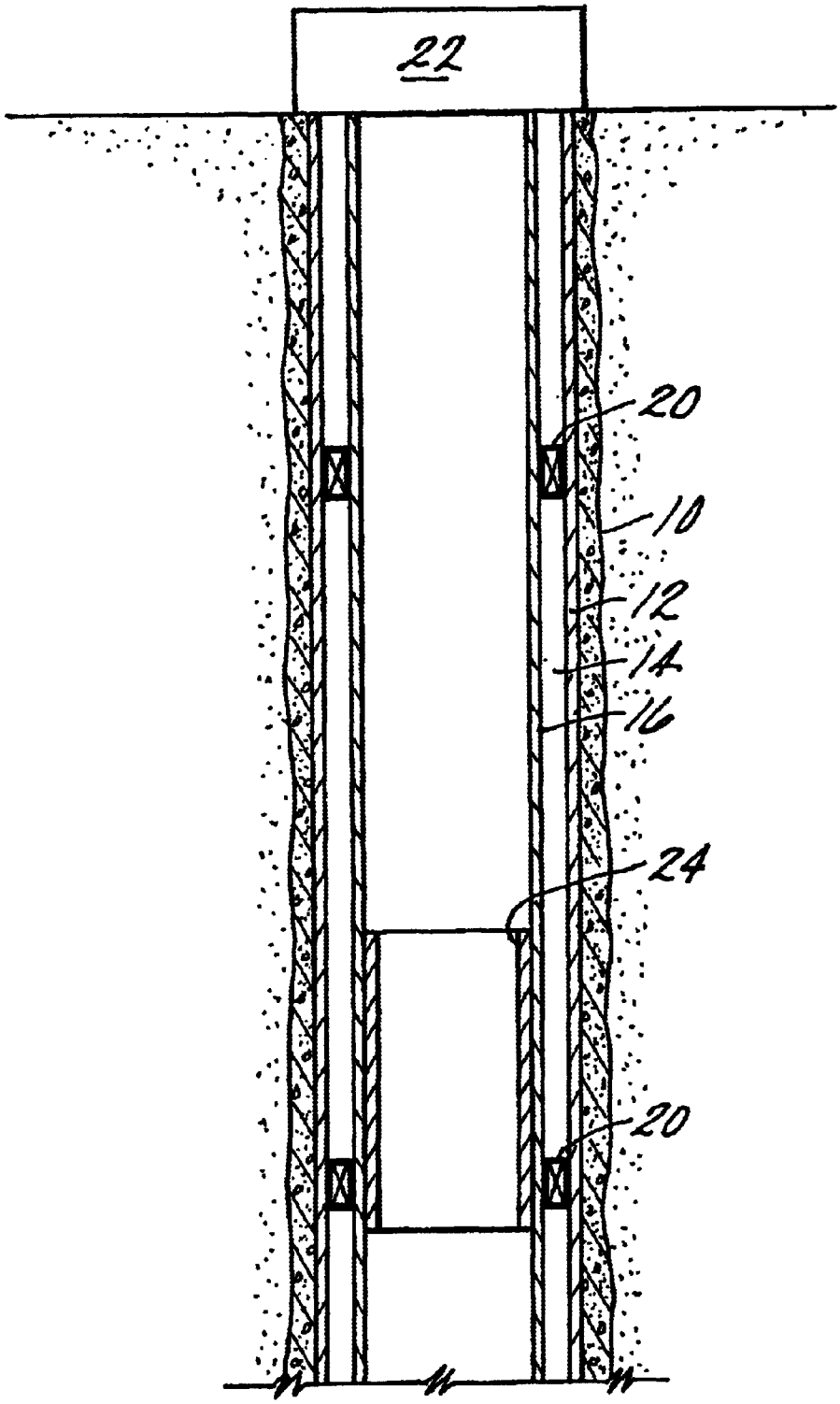
FIG. 1 is a schematic representation of the invention.

Referring to FIG. 1, a schematic illustration of the invention is provided. The schematic shows the borehole 10, casing 12, annulus 14, tubing 16, packers 20, vibration source 22 and tool 24. Communicating with downhole tool 24 by means of the invention is accomplished by creating vibrations which are distinguishable and identifiable by the tool having appropriate electronic apparati connected therewith (discussed in detail hereunder). Two preferred vibration sources that meet the stated criteria are: one, vibration requiring the use of a special apparatus available commercially from Baker Oil Tools, Houston, Tex. as the thumper surface system for rent; and two, pump vibration caused by operating the rig pump to circulate fluid. The former may provide a shorter time for actuation by applying inherently distinct vibration while the latter is less expensive due to the avoidance of another piece of equipment. The latter may be somewhat slower due to threshold times for recognition of a pump on/pump off activity. The time difference, however is negligible. Both of these preferred vibration initiators, therefore, are highly effective as an integral part of the remote actuation system of the invention. Vibration traveling through well fluid, preferably in the annulus, although it could be in the tubing fluid, couples with the tubing string while it propagates. Vibration which has coupled to the tubing string will continue downhole around obstructions like hardware installed in the annulus such as a packer or gas bubbles in the fluid column. For example, when an acoustic pulse, which may have been the vibration source, reflects back uphole, the vibration which coupled to the tubing will continue on and likely will reach the tool it is intended to actuate. The coupling to the tubing of the vibrating energies put in the system in the various ways indicated, is the link that makes the communication, and therefore the remote actuation of tools, possible.

Figure 2A:
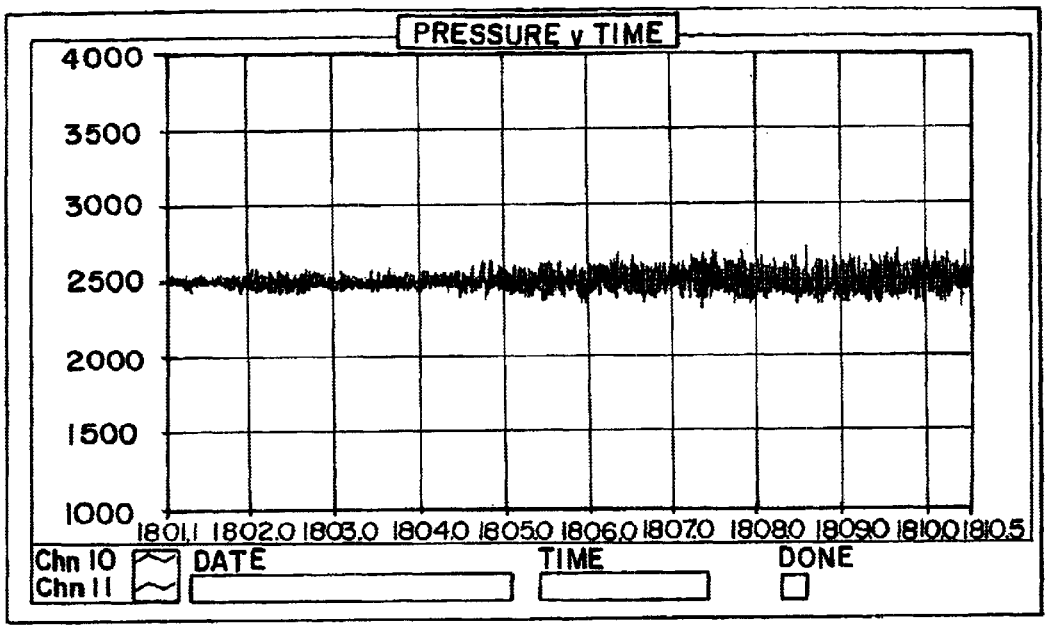
FIG. 2A is a sonogram illustrating a baseline reading to starting flow.
Figure 2B:
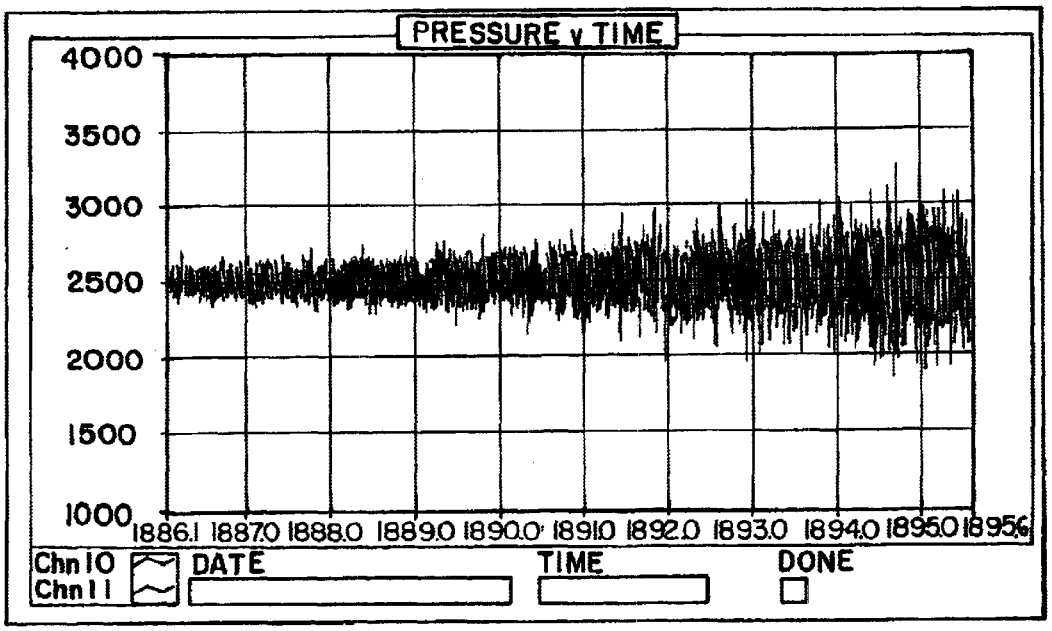
FIG. 2B is a sonogram illustrating 50 SPM and increasing to 120 SPM.
Figure 2C:
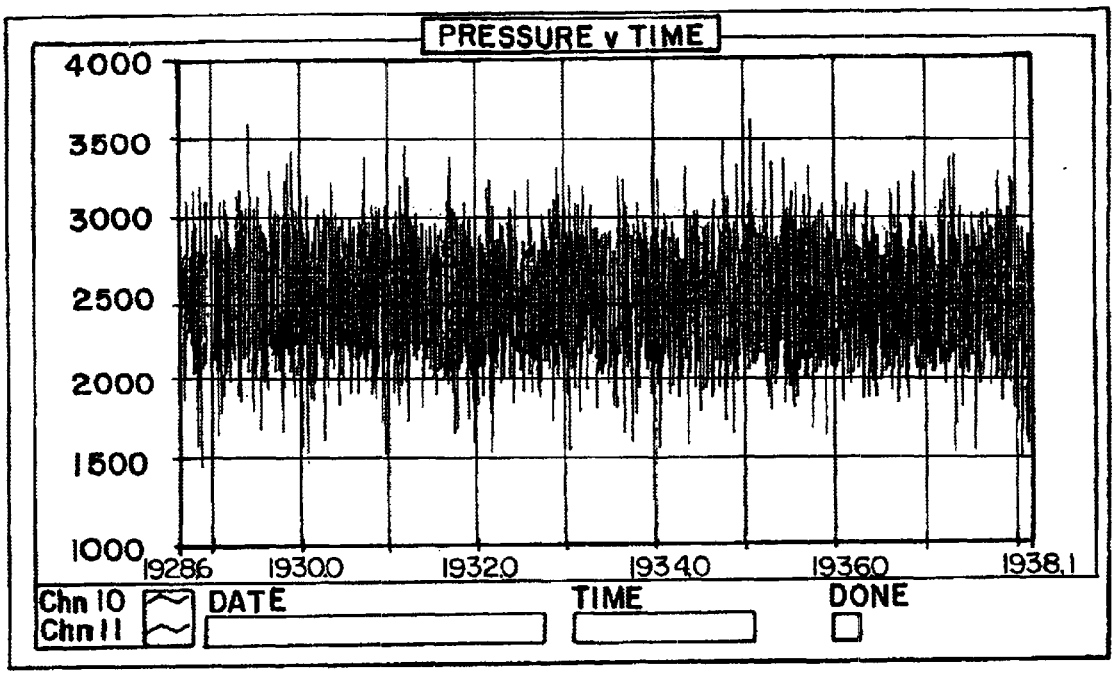
FIG. 2C is a sonogram illustrating sustained 120 SPM.
Figure 2D:
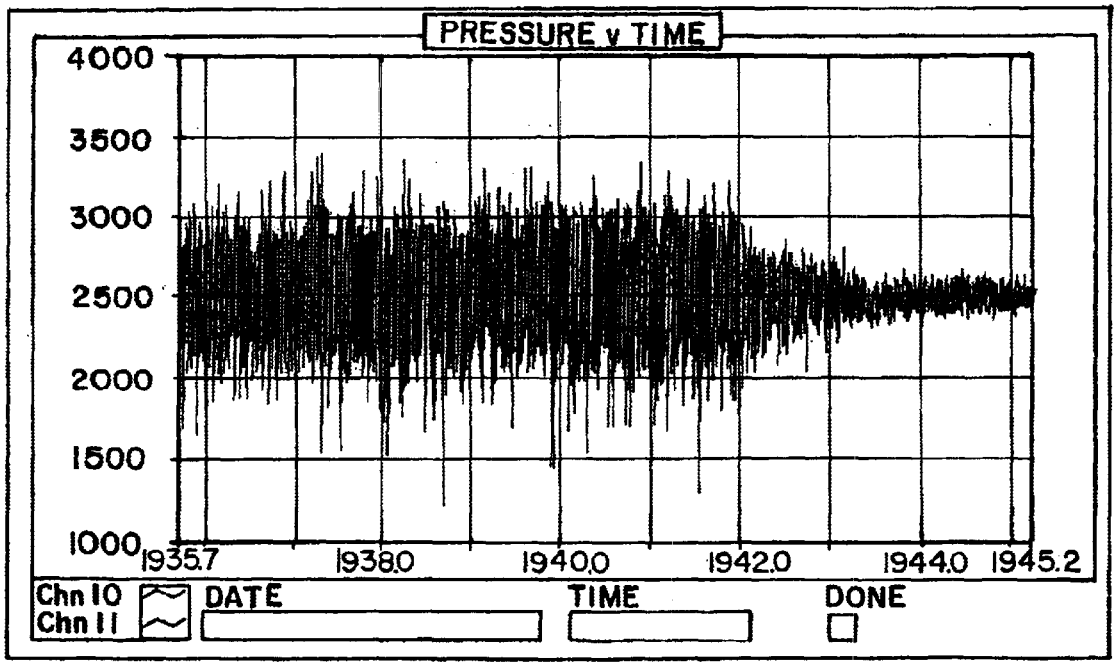
FIG. 2D is a sonogram illustrating 120 SPM to 50 SPM.

The downhole tools to be actuated by the remote actuation system of the invention employ at least one accelerometer which will measure acceleration, or in other words sense vibration, in one direction. In this case the accelerometer should be oriented to measure acceleration in the axial direction of the tubing. The preference for an axial accelerometer is that this is the direction of most of the vibration. While a single accelerometer will function well, it is advantageous to use at least two accelerometers to track vibration in two axes (i.e X and Y) which are preferably in the axis of the tubing and transverse to the tubing respectively, to increase the sensitivity of the system. In a preferred embodiment at least two, as discussed, or even three accelerometers X, Y and Z might be employed to render the tool more sensitive to vibration. Since filters are employed in the microcontroller discussed hereunder, the extra sensitivity of the additional accelerometers does not negatively affect precision of the system. The filters allow the microcontroller to "hear" only the correct vibrations. Referring to FIGS. 2A–2C several sonograms are illustrated which indicate some of the different vibrations created by different sources. It will be understood that distinguishing between these sounds is reliably assured by appropriate filters and receptors which are known to artisans of skill in the relevant art.

Figure 3:
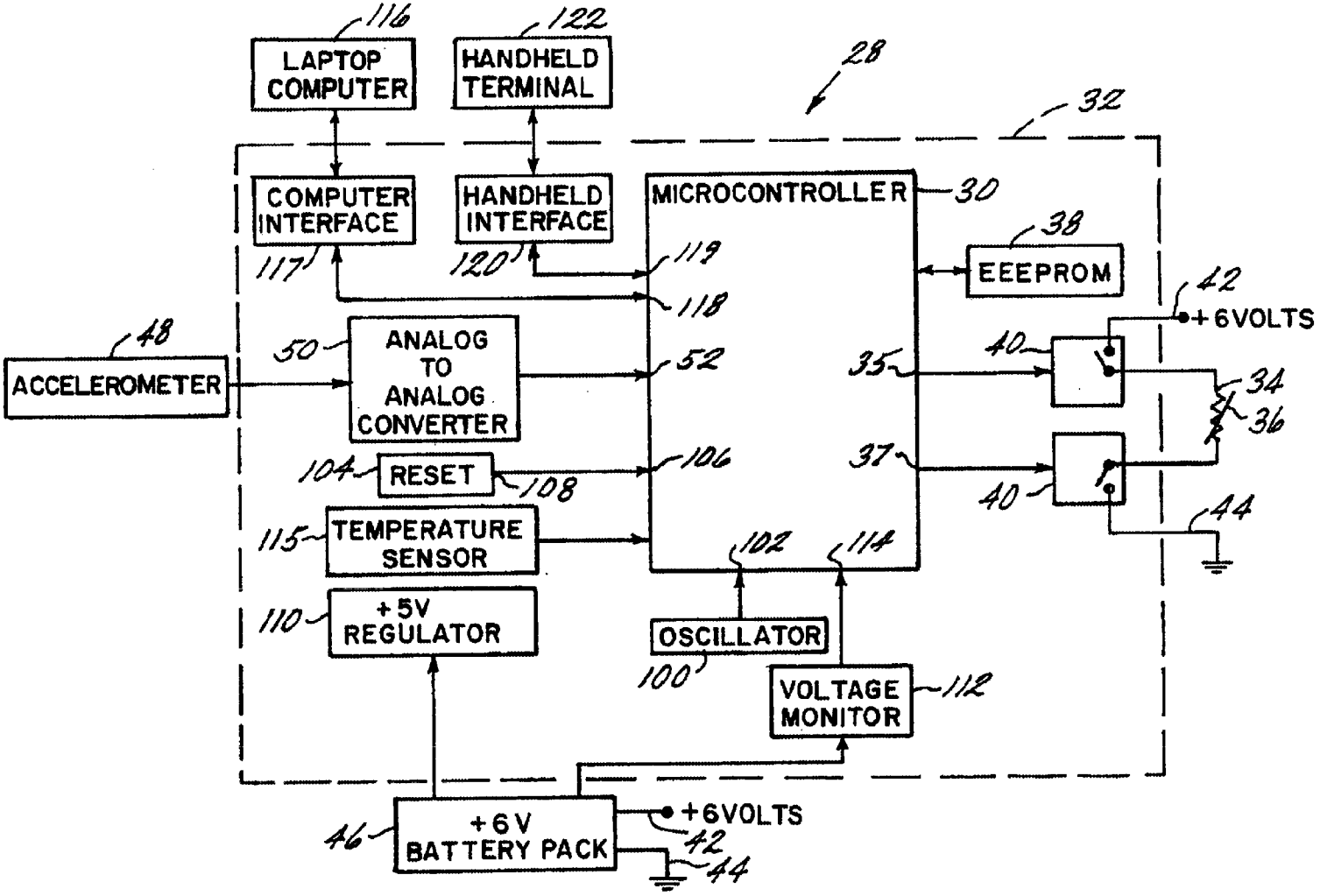
FIG. 3 is a schematic representation of the vibration receiving system associated with a downhole tool.

Referring to FIG. 3, a schematic representation of the vibration receiving system 28 shows a microcontroller 30 mounted on printed circuit board 32. The microcontroller includes a computer program stored in internal memory embedded therein that defines a pump detection algorithm. In accordance with the algorithm, the microcontroller 30 monitors the vibrations generated by the vibration source 22, such as a pump, located at the surface of the well (see FIG. 1). In response to a sequence of alternating periods (on and off periods) of vibrations generated by the pump 22, the microcontroller 30 actuates the tool 24 by applying a current through a nichrome element 34 embedded in Kevlar 36. The parameters of the vibration sequence recognized by the microcontroller for actuating the tool are programmed into the vibration receiving system 28 by the user, which is described in greater detail hereinafter. For example, the vibration sequence for actuating the tool 24 may include a sequence of sixty (60) seconds of vibration ("On" period) and thirty (30) seconds of no vibration ("Off" period) that is repeated four (4) times. Whatever sequence is desired may be stored into an EEPROM 38 depending upon the conditions in the well, other tools to be actuated, etc. Once the sequence parameters are stored in the EEPROM, the tool 24 is powered (or armed) and is run downhole to the selected location and the vibration sequence is begun, as noted above, preferably by cycling the rig pump or by employing the acoustic pulse generator 22 disclosed in U.S. Pat. No. 5,579,283 (previously incorporated herein by reference).

As shown schematically in FIG. 3, a pair of field effect transistor (FET) switches 40 are connected to the ends of the nichrome element 34. The FET switches are in the normally open state to prevent current from flowing through the nichrome element 34. In response to the appropriate vibration sequence, the microcontroller 30 generates a pair of signals at output ports 35, 37 to energize each respective FET switch 40 which applies the positive terminal 42 of the battery pack 46 to one end of the nichrome element 34 and the negative terminal 44 of the battery pack to the other end of the nichrome element. The current through the nichrome element heats and burns through the Kevlar 36 to allow the actuation sequence of the tool 24 itself to proceed. Each end of the nichrome element is switched to the battery pack to prevent accidental firing of the nichrome element. Having redundant FET switches 40 for connecting each terminal 42, 44 of the battery pack 46 to the nichrome element 34 prevents premature or accidental firing of the nichrome element should one of the FET switches fail in the closed or shorted state. In the present configuration, despite the failure of one of the FET switches wherein one end of the nichrome element shorts to the respective battery terminal, the other FET switch permits normal operation of the receiver system 28.

Figure 2E:
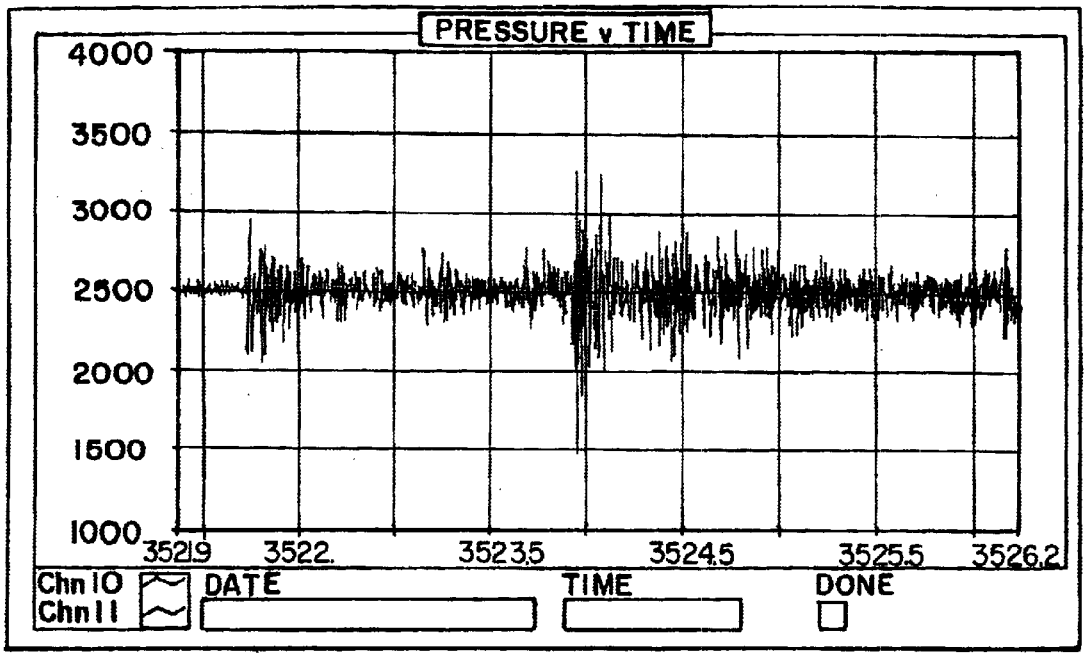
FIG. 2E is a sonogram illustrating noise in the system.

The accelerometer 48 provides an ac voltage output signal as shown in FIGS. 2A–2E. The referenced FIGURES illustrate a sequence at various stages of the flow noise (see FIGS. 2A–2D) and noise in the system which is to be filtered out and not "heard" by the microcontroller. As will be appreciated by one of ordinary skill in the art, the graph shown in FIG. 2E illustrates an inconsistent pattern and is therefore easily distinguished by the electronics of the invention. The accelerator is connected to an analog-to-analog converter 50 which converts the RMS (root mean square) value of the accelerometer output signal to a corresponding dc voltage signal. The dc voltage signal is provided to input port 52 of the microcontroller 34. The microcontroller includes an internal analog-to-digital (A/D) converter (not shown) that converts the dc voltage signal to a corresponding digital signal for use by the microcontroller.

Figure 4:
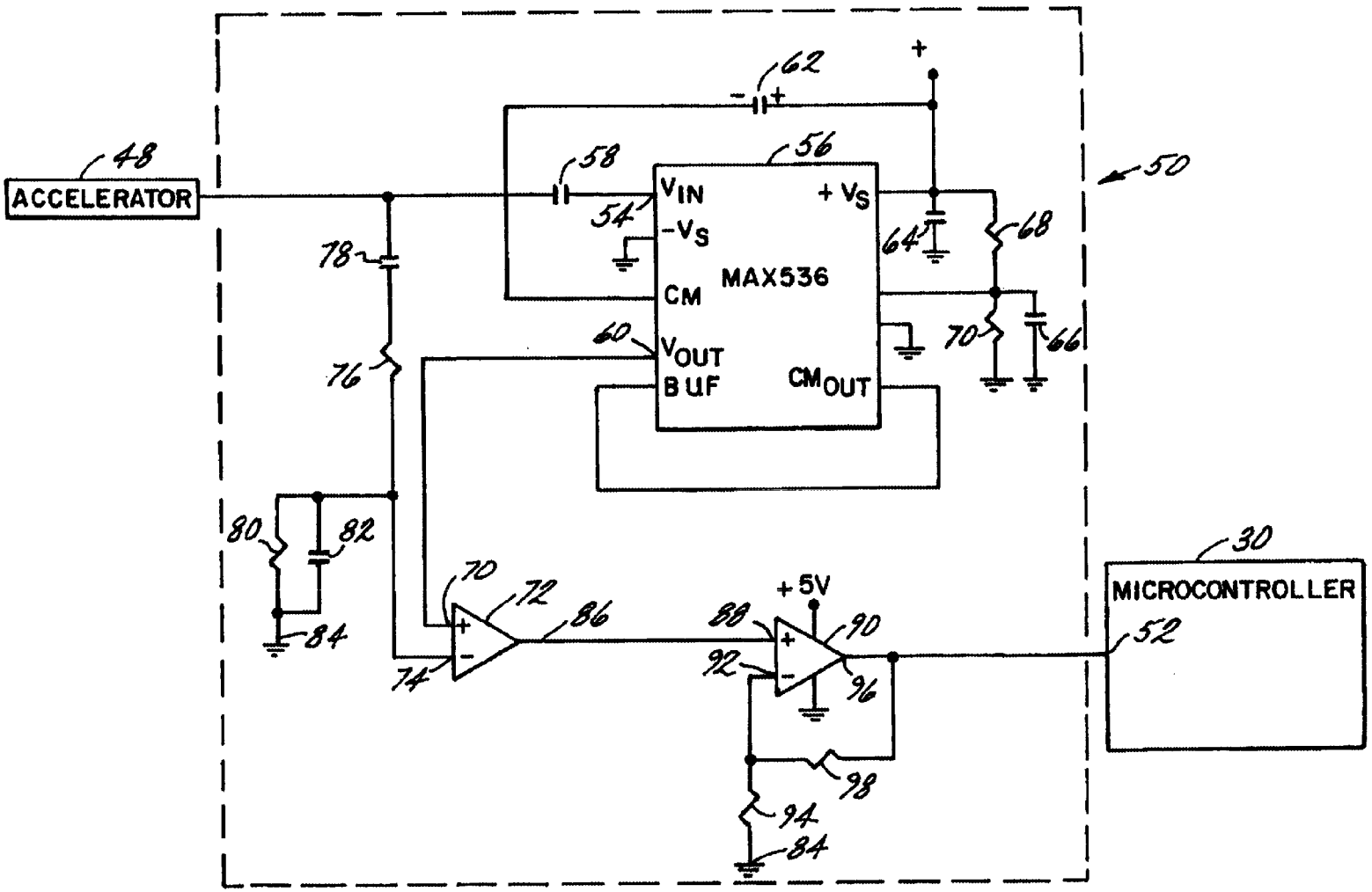
FIG. 4 is a schematic diagram of an analog-to-analog converter of the vibration receiving system of FIG. 3.

FIG. 4 illustrates a schematic diagram of the analog-to-analog converter 50. The output of the accelerator 48 is provided to input port 54 of an integrated circuit 56 through capacitor 58. The integrated circuit 56 converts the RMS value of the accelerator signal to a dc voltage at output port 60. The integrated circuit 58 is preferably a maxim 536 integrated circuit available commercially from Maxim Integrated Products, Inc. Sunnyvale, Calif. It will be appreciated that other analog-to-analog converter ICs may be substituted. It is important that the maximum operational temperature of the integrated circuit is sufficient to withstand downhole temperatures. The integrated circuit identified above provides a working range of between 125° C. to 150° C.

Capacitors 62–66 and resistors 68, 70 are interconnected to integrated circuit 56 in a known arrangement for filtering and properly scaling the output dc voltage at port 60. The output dc voltage at port 60 of integrated circuit 56 is provided to the positive terminal 70 of comparator 72. The output signal of the accelerator 48 is also provided to the negative terminal 74 of comparator 72 through capacitor 76 and resistor 78 connected in series. Capacitor 80 and resistor 82 are connected in parallel between the negative terminal 74 of comparator 72 and ground 84. The RC networks filter the accelerator output signal to provide a baseline signal of the accelerator output signal to comparator 72. The comparator 72 provides a dc output voltage representative of the accelerator output signal minus the baseline voltage at terminal 86. The dc output voltage at 86 is provided to the positive terminal 88 of the operational amplifier 90. The negative terminal 92 of amplifier 90 is connected to ground 84 through resistor 94 and is connected to its output terminal 96 through feedback resistor 98. Operational amplifier 90 amplifies the dc voltage signal at 86 to a suitable voltage to be received by the microcontroller 30 at port 52.

Referring to FIG. 3, the timing for the microcontroller 30 is provided by a crystal oscillator 100 which is connected to port 102. A reset circuit 104 is connected to the microcontroller at port 106 for resetting the microcontroller when +5 volt power is applied to the vibration receiving system 28 at start-up. The reset circuit generates a low output signal at terminal 108 in response to +5 volt power being applied thereto which resets the microcontroller 30.

The +6 volt battery pack 46 is connected to a +5 volt dc regulator 110 which converts the +6 volt power to a regulated +5 volt for powering the electronics of circuit board 32.

The vibration receiving system 28 also includes a circuit 112 for monitoring the output voltage of the battery pack 46 to determine whether the battery pack is sufficiently charged. The voltage monitoring circuit 112 generates an output signal representative of the voltage of the battery pack and provides it to input port 114 of the microcontroller 30. In a preferred embodiment, the battery pack 46 is preferably a flex battery pack commercially available from Baker Oil Tools, Houston, Tex., and covered by U.S. Pat. No. 5,516,603, the entire contents of which are incorporated herein by reference. The battery pack preferably employs nine cells. Two of the nine cells are reserved for the microcontroller 30 while the other seven cells power both the remaining components of the circuit board 32 and the nichrome element 34. The two reserved cells prevent current drop in the microcontroller 30 during powering of the nichrome element 34 which might otherwise reset the microcontroller.

EPROM 38 provides non-volatile memory for storing parameters used by the algorithm controlling the energization of the FET switches. The EEPROM may also be used to store the computer software therein.

As described hereinafter in greater detail, the vibration receiving system 28 may be armed (powered up) at the surface of the well prior to lowering the tool 24 into the well. In an alternative, the receiving system may be armed within the wellhole at a predetermined depth. This delaying in powering the receiving system 28 aids to conserve the power of the battery pack 46. A temperature sensor 115 provides a signal to the microcontroller 30 representative of the temperature of the wellhole. The microcontroller is programmed to arm the receiving system when the temperature of the hole reaches a predetermined value.

The microcontroller 30 is programmable at the drill site using a laptop computer 116. The laptop computer communicates through a computer interface 117 that provides a standard RS232 interface to port 118 of the microcontroller 30. To conserve on-board battery power, the laptop computer 116 provides external power to energize the electronics on the circuit board while programming the microcontroller. The tool must be disassembled to provide access to the RS232 interface for interconnecting the laptop computer to the microcontroller. Once the tool 24 is assembled, communication with the microcontroller 30 is available only through a single prong terminal interface, such as a Kemlon connector, which allows an electrical connection of a handheld terminal 122 to the microcontroller. A handheld interface 120 is designed to communicate with the handheld terminal, which is a dumb terminal, via the RS232 serial port. The parameters for the serial interface is 2400 baud, 8 bits, 1 stop bit and no hardware or software handshake.

The handheld terminal 122 is used to select the necessary parameters for defining the proper vibration sequence required to command the microcontroller 30 to energize the nichrome element 34. When the vibration receiving system 28 is successfully powered up, the handheld terminal 122 will display a main menu 124 shown in FIG. 5. The main menu serves two purposes. First, it shows the current parameter settings. Second, it allows an opportunity to change the settings, arm the tool 24, save the current settings and obtain an abbreviated help screen. This is done by typing a letter A–F that corresponds to the desired setting to be changed. The handheld terminal 122 includes a display screen and alphanumeric keypad (not shown) for entering parameters and commands. The following four parameters that may be stored in memory for use by the pump detection algorithm are the "Pump-On Threshold", the "Pump-On Period", the "Pump-Off Period" and the "Pump Cycle".

Figure 6:
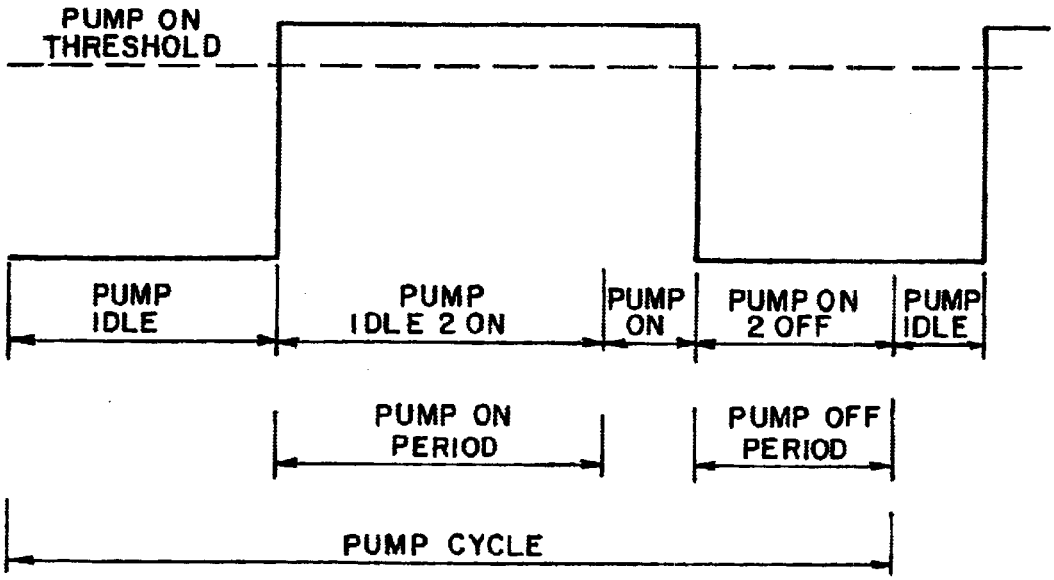
FIG. 6 is a graphical representation of the output voltage signal provided by an accelerator to an input port of a microcontroller of the vibration receiving system.

FIG. 6 illustrates the accelerator signal during a single "Pump On", cycle of the vibration source 22 located at the surface of the well. Referring to FIGS. 3 and 6, the "Pump-On Threshold" is the minimum output voltage signal provided by the accelerator 48 at port 52 required by the microcontroller to recognize a vibration signal generated by the vibration source (or pump) 22 as a "pump-on" signal. Therefore, a voltage greater than the "Pump-On Threshold" parameter is indicative of the pump 22 being activated to provide a "pump-on" signal and a voltage less than the "Pump-On Threshold" is indicative of the pump being deactivated to provide a "pump-off" signal. The input voltage at port 52 of the microcontroller 30 is converted to a corresponding number of counts. The "Pump-On Period" is the minimum period of time in seconds that the accelerator output signal must be above the "Pump-On Threshold" for the microcontroller to consider the "pump-on" signal to be acceptable. The "Pump-Off Period" is the minimum period of time in seconds that the accelerator output signal must be below the "Pump-On Threshold" for the microcontroller 30 to consider the "pump-off" signal to be acceptable. The "Pump Cycle" is the minimum number of valid pump on cycles required to execute a valid flow detection sequence.

Upon power up, the microcontroller 30 reads the parameters stored in the EEPROM 38 and sends the main user menu of FIG. 5 through the RS232 interface to the handheld terminal 122. The current "Pump-On Threshold", the "Pump-On Period", the "Pump-Off Period" and the "Pump Cycle" parameters are displayed. A list of commands are also displayed to the user. Entering of an appropriate command allows the user to enter a new value for a selected parameter. These values are saved in the EEPROM only at the user's request.

FIGS. 7*a–g* illustrate the submenus of the main menu. If the user wishes to change any of the parameters, the appropriate letter is entered. When the user enters an "a" or "A" at the command prompt of any menu, the user is prompted to enter the new "Pump-On Threshold" parameter in submenu 126 of FIG. 7*a*. The "Pump-On Threshold" is entered as the number of counts which corresponds to an average voltage at port 52 of the microcontroller 30. For example, 4.00 volts corresponds to 9421 counts and 2.0 volts corresponds to 4710 volts. When the user enters a "b" or "B" at the command prompt of any menu, the user is prompted to enter the new "Pump-On Period" parameter in submenu similar to submenu 126 of FIG. 7*a*. When the user enters a "c" or "C" at the command prompt of any menu, the user is prompted to enter the new "Pump-Off Period" parameter in submenu similar to submenu 126 of FIG. 7*a*. When the user enters a "d" or "D" at the command prompt of any menu, the user is prompted to enter a new "Pump Cycle" parameter in submenu similar to submenu 126 of FIG. 7*a*. The election of a nonnumeric input including the return or enter key for any of the above parameters will terminate the input sequence and prompt the user to reenter the parameter.

When the user enters an "e" or "E"at the command prompt of any menu, the user is prompted to confirm that the user wishes to arm the tool by typing "y" for yes for arming and "n" for no for not arming the tool in submenu 132 of FIG. 7*b*. When the user enters an "f" or "F" at the command prompt of any menu, the user is prompted to confirm that the user wishes to save the current parameters into the EEPROM 38 in submenu 134 of FIG. 7*c*. The user enters "y" for yes to confirm and "n" for no to return to the main menu. Once the confirmation is obtained, the microcontroller 30 sends out a result message such as the parameters are saved or not saved. If the parameters are not saved, then this is an indication that the EEPROM is not functioning properly. When the user enters a "?" at the command prompt of any menu, the microcontroller redisplays the main menu of FIG. 5 displaying any changed parameters. If the user enters any command other than the choices available to the user, an invalid message is displayed and the user is prompted to reenter a new command.

Furthermore, the handheld terminal 122 may be used to interface with the microcontroller 30 for testing the firmware. Several of the tests involve the use of an integrated circuit (not shown), such as an In Circuit Emulator (ICE). Though this is an intrusive test tool, it provides the most effective method of monitoring firmware performance. One of the tests includes a hardware initialization test that verifies the operation of the hardware initialization function by initializing the microcontroller 30 and other circuit board hardware. The user may also verify the operation of the power on self-test (POST). This function performs a power up self-test of the hardware. It performs an EEPROM write/read test and RAM write/read test. The test results are then stored in the EEPROM 38. The user may also test the applications function of the microcontroller. In addition, the tests verify the operation of the pump detection algorithm by testing that the algorithm functions properly under at least three simulated accelerator output conditions. First, the algorithm is tested wherein the simulated input for a proper pump cycle is provided. Second, a simulated input signal emulating a premature Pump-Off condition after reaching "Pump-On Threshold" is provided. Third, an input condition signal emulating a premature Pump-Off condition during the "Pump-Off Period" is provided.

Figure 8:
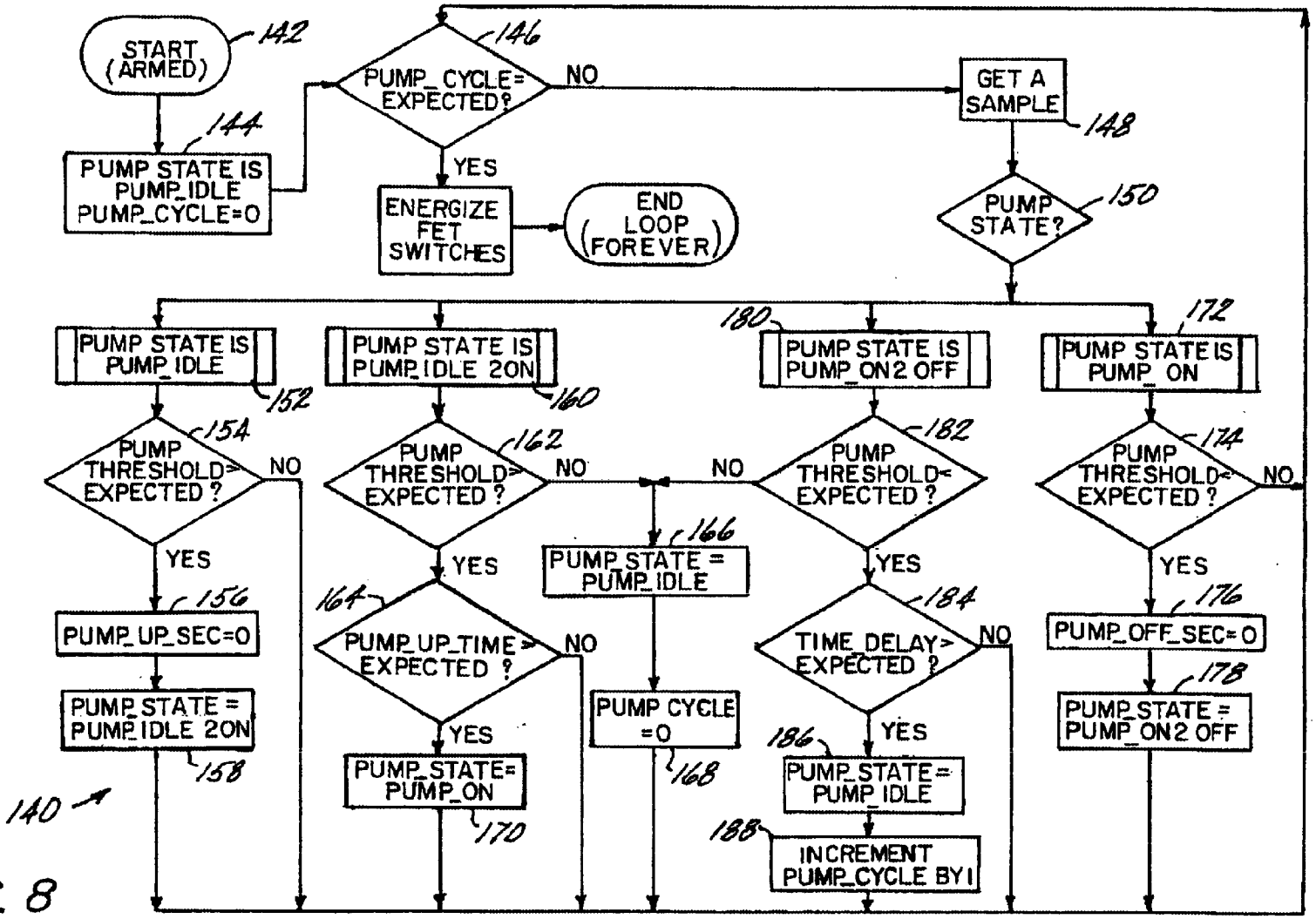
FIG. 8 is a flow diagram of a pump detection algorithm for controlling the operation of the vibration receiving system.

The flow diagram of FIG. 8 illustrates the Pump Detection Algorithm 140 that describes the condition and sequence of turning "on" the output of the microcontroller 30 to energize the nichrome element 34 in response to an accelerator signal having an appropriate number of pump cycles defined by the parameters stored in the EEPROM 38. The microcontroller monitors each pump cycle to insure that the on and off periods are continuous for the defined time periods.

Referring to block 142 of FIG. 8, the microcontroller 30 is first armed, and then a pump-state variable is set to PUMP_IDLE and the pump-cycle variable is set to zero in block 144. The pump-state variable is representative of the state of the vibration source (pump) 22 of a pump-on cycle. The pump-cycle variable is representative of the number of pump-on cycles that have been completed. If the pump-cycle is not equal to the stored "Pump Cycle" parameter stored in the EEPROM 38 as shown in block 146, the microcontroller 30 senses the accelerator output signal at input port 52 to provide the pump value as shown in block 148. Referring to block 150, the control path of the algorithm depends upon the condition of the pump state variable.

Initially, the pump state variable is PUMP_IDLE and therefore, control passes to the PUMP_IDLE routine at block 152. If the pump value is less than the "Pump-On Threshold" parameter stored in the EEPROM 38, the microcontroller 30 continues monitoring the accelerator output signal at block 148 until the pump value exceeds the "Pump-On Threshold" parameter (see block 154). When the pump value exceeds the "Pump-On Threshold" parameter in block 154, the microcontroller sets the pump-up-sec variable to zero and changes the pump state variable to PUMP_IDLE2ON in blocks 156 and 158, respectively (also see FIG. 6). The pump-up-sec variable provides the initial count for a timer that times the "Pump-On Period" and "Pump-Off Period".

At block 150, the pump state variable is PUMP_IDLE2ON and therefore, control passes to the PUMP_IDLE2ON routine in block 160. In block 162, the microcontroller 30 continues to monitor its input port 52 for a pump value greater than the "Pump-On Threshold" parameter. If the pump value drops below the "Pump-On Threshold" parameter before the "Pump-On Period" has expired (see block 164), the pump-state variable is reinitialized back to PUMP_IDLE state and the pump-cycle variable back to zero as shown in blocks 166 and 168, respectively. If the pump value remains above the pump threshold, control will continue to flow through the PUMP_IDLE2ON routine until the pump value has remained above the "Pump-On Threshold" parameter for the entire "Pump-On Period". At this time, the pump state is change to PUMP_ON state at block 170, as shown in FIG. 6.

At block 150, the pump state variable is PUMP_ON and therefore, control passes to the PUMP_ON routine in block 172. In block 174, the microcontroller 30 continues to monitor its input port 52 for a pump value less than the "Pump-On Threshold" parameter (see block 174). When the pump value drops below the "Pump-On Threshold" parameter in block 174, the microcontroller 30 sets the pump-up-sec variable to zero and changes the pump state variable to PUMP_ON2OFF in blocks 176 and 178, respectively (see FIG. 6).

At block 150, the pump state variable is PUMP_ON2OFF and therefore, control passes to the PUMP_ON2OFF routine in block 180. In block 182, the microcontroller 30 continues to monitor its input port 52 for a pump value less than the "Pump-On Threshold" parameter. If the pump value increases above the "Pump-On Threshold" parameter before the "Pump-Off Period" has expired (see block 184), the pump-state variable is reinitialized back to PUMP_IDLE state and the pump-cycle variable back to zero as shown in blocks 166 and 168, respectively. If the pump value remains below the "Pump-On Threshold" parameter, control will continue to flow through the PUMP_ON2OFF routine until the pump value has remained below the "Pump-Off Threshold" parameter for the entire "Pump-Off Period". At this time, the pump state is change to PUMP_IDLE state at block 186 and the pump-cycle variable is incremented by 1 at block 188.

The microcontroller 30 will continue to cycle through each of the four routines to complete each "on-off" cycle until the pump-cycle variable is equal to the number of "Pump Cycles" stored in the EEPROM 38. When the correct number of pump cycles is completed (see block 146), the microcontroller 30 generates a pair of signals to energize the FET switches 40 to connect the battery pack 46 across the nichrome element 34 as shown in FIG. 3. The pump detection algorithm 140 then ends.

The vibration receiver system 28 of the invention is contained mostly within an atmospheric chamber in the downhole tool 24, the accelerometer 48 being located preferably in a hole drilled in the external surface of the tool and retained therein preferably with epoxy. For each axis accelerometer, an additional hole in the tool would be provided. It is possible, however, to have each of the axes to be sensed contained in a single package and therefore mountable in a single hole in the tool.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A remote downhole tool actuation system comprising:

a fluid pump vibration initiator;

a vibration propagator in vibrating communication with said vibration initiator; and a vibration receiver attachable to said downhole tool and in communication with an actuator of said tool.

2. A remote downhole tool actuation system as claimed in claim 4 wherein said vibration initiator is selectively activatable.

3. A remote downhole tool actuation system as claimed in claim 2 wherein said initiator is an acoustic pressure pulse generator.

4. A remote downhole tool actuation system as claimed in claim 1 wherein said vibration propagator is a column of fluid in a wellbore.

5. A remote downhole tool actuation system as claimed in claim 1 wherein said vibration propagator is a tubing string in a wellbore.

6. A remote downhole tool actuation system as claimed in claim 1 wherein said vibration propagator is a column of fluid in a wellbore and a tubing string in said wellbore.

7. A remote downhole tool actuation system as claimed in claim 1 wherein said vibration receiver is at least one accelerometer connected with said downhole tool.

8. A remote downhole tool actuation system as claimed in claim 7 wherein said at least one accelerometer is at least two accelerometers connected with said downhole tool and oriented to sense acceleration in axes generally perpendicular to one another.

9. A remote downhole tool actuation system as claimed in claim 7 wherein said at least one accelerometer is oriented to sense vibrations traveling axially in at least one of a fluid column and a tubing string in a wellbore.

10. A remote downhole tool actuation system as claimed in claim 1 wherein said actuator further comprises a controller having a programmable memory and which compares a vibration sequence received from said vibration receiver with a vibration sequence stored in the programmable memory and actuates said tool when said vibration sequence stored in said memory substantially matches said vibration sequence received by said vibration receiver.

11. A remote downhole tool actuation system as claimed in claim 10 wherein said vibration sequence includes a series of vibration on and vibration off conditions each for selected amounts of time.

12. A method of remotely actuating a downhole tool comprising:

causing a vibration in a tubing string of a wellbore by selectively operating machinery having a function other than causing vibration;

propagating said vibration downhole;

sensing said vibration; and actuating said tool upon said sensing.

13. A method of remotely actuating a downhole tool as claimed in claim 12 wherein said vibration is a sequence of vibrations.

14. A method of remotely actuating a downhole tool as claimed in claim 12 wherein said vibration is caused by creating an acoustic pulse in a fluid in said wellbore.

15. A method of remotely actuating a downhole tool as claimed in claim 14 wherein said fluid is tubing fluid.

16. A method of remotely actuating a downhole tool as claimed in claim 14 wherein said fluid is annulus fluid.

17. A method of remotely actuating a downhole tool as claimed in claim 12 wherein said vibration is caused by pumping fluid in said wellbore.

18. A method of remotely actuating a downhole tool as claimed in claim 12 wherein said vibration is caused by operating machinery vibrationally coupled to said wellbore, said machinery, producing vibration incident to its operation.

19. A method of remotely actuating a downhole tool as claimed in claim 13 wherein said sensing includes providing at least one accelerometer in proximate communication with said downhole tool, said accelerometer sensing said vibrations in said wellbore.

20. A method of remotely actuating a downhole tool as claimed in claim 19 wherein said at least one accelerometer is a plurality of acceleration each sensing acceleration in individual directions.

21. A method for communicating in a wellbore comprising:

generating a vibration at a first location by selectively operating machinery having a function other than causing vibration;

propagating said vibration; and sensing said vibration at a second location.

22. An apparatus for actuating a downhole tool remotely in response to a defined sequence of vibrations created by selectively operating machinery having a function other than causing vibration; said apparatus comprising:

a transducer for generating an electrical signal representative of the sensed vibrations; and a computer in communication with said transducer, said computer actuating the downhole tool in response to the defined sequence of vibrations.

23. An apparatus as claimed in claim 22 wherein said transducer includes at least one accelerometer.

24. An apparatus as claimed in claim 22 further comprises a memory for storing a set of instructions that define an algorithm for recognizing the defined sequence of vibrations.

25. An apparatus as claimed in claim 22 further comprising a memory for storing at least one parameter that defines the sequence of vibrations.

26. An apparatus as claimed in claim 25 wherein said parameter includes at least one parameter of a group consisting of a minimum time period the vibration must be present, a minimum time period the vibration must be absent, and a number of cycles of vibration that define said sequence.

27. An apparatus as claimed in claim 26 further includes a communication device to enable a user to store said parameter in said memory.

28. An apparatus for actuating a downhole tool remotely in response to a defined sequence of vibration, said apparatus comprising:

a transducer for generating an electrical signal representative of the sensed vibrations; and a computer in communication with said transducer, said computer actuating the downhole tool in response to the defined sequence of vibrations; and a converter for generating a direct current voltage signal representative of the root mean square value of said electrical signal, wherein said direct current voltage signal is provided to said computer.

29. An apparatus as claimed in claim 28 wherein said converter includes:

a circuit for filtering said electronic signal of said transducer to provide a baseline signal representative of the electronic signal when no vibration is present; and a comparator for subtracting said baseline signal from said direct voltage signal to generate a compensated signal.

30. An apparatus as claimed in claim 29 wherein said converter further includes an amplifier for conditioning said compensated signal to be received by said computer.

31. An apparatus as claimed in claim 22 further comprising at least one switching device connected to said computer, said computer actuating said switching device in response to a defined vibration sequence to actuate the tool.

32. An apparatus as claimed in claim 31 further comprising a heating element connected to said switching device.

33. An apparatus as claimed in claim 32 wherein said heating element includes a nichrome element.

34. An apparatus as claimed in claim 22 further comprises a pair of switching device connected to said computer, each of said switching device being connected to an end of a heating element, wherein actuation of said switching devices in response to a defined vibration sequence applies a current through said heating element to actuate the tool.

35. An apparatus as claimed in claim 22 further includes a voltage storage device for powering said apparatus.

36. An apparatus as claimed in claim 22 further includes a communication device connected to said computer to enable a user to arm said apparatus.

37. An apparatus as claimed in claim 22 further includes a temperature sensing device to provide a signal to said computer representative of the ambient temperature of said apparatus, and wherein said computer arms said apparatus in response to a defined temperature level.

38. An apparatus as claimed in claim 29 wherein said circuit for filtering includes a pair of resistor-capacitor networks.

39. A method of detecting a sequence of vibrations created by selectively operating machinery having a function other than causing vibration, said method comprising the steps of:

receiving an electronic signal representative of the presence of a vibration;

verifying the presence of a vibration for a first defined period of time;

verifying the absence of a vibration for a second defined period of time; and generating an actuation signal in response to the sequential repeating of verifying the presence of a vibration and verifying the absence of a vibration for a defined number of cycles.

40. A method as claimed in claim 39 further includes the step of providing an accelerometer for generating the electronic signal.

41. A method as claimed in claim 39 wherein said verifying the presence of a vibration includes the steps of:

comparing the electronic signal to a defined threshold level; and verifying the level of the electronic signal is greater than the defined threshold level for the first defined period of time.

42. A method as claimed in claim 39 wherein said verifying the absence of a vibration includes the steps of:

comparing the electronic signal to a defined threshold level; and verifying the electronic signal level is less than the defined threshold level for the second defined period of time.

43. A method as claimed in claim 39 further includes the step of reinitializing the number of cycles required to generate the actuation signal in response to the presence of vibration for less than said first defined period of time.

44. A method as claimed in claim 39 further includes the step of reinitializing the number of cycles required to generate the actuation signal in response to the absence of vibration for less than said second defined period of time.

45. A method as claimed in claim 39 further includes the step of defining said first and second period of time by a user.

46. A method as claimed in claim 39 further includes the step of defining said threshold value by a user.

47. A remote downhole tool actuation system comprising:

a vibration initiator having a function other than as a vibration source;

a vibration propagator in vibrating communication with said vibration initiator; and a vibration receiver attachable to said downhole tool and in communication with an actuator of said tool.

* * * * *